United States Patent [19]

Mamberer

[11] 4,390,958

[45] Jun. 28, 1983

[54] ELECTRO-OPTICAL MEASURING APPARATUS TO COVER ZONES OF DIFFERENT WIDTHS AND OBTAIN COMPUTED UTILIZATION SIGNALS FOR PRINTING APPARATUS

[75] Inventor: Hans E. Mamberer, Königsbrunn, Fed. Rep. of Germany

[73] Assignee: M.A.N.-Roland Druckmaschinen Aktiengesellschaft, Offenbach am Main, Fed. Rep. of Germany

[21] Appl. No.: 212,034

[22] Filed: Dec. 2, 1980

[30] Foreign Application Priority Data

Dec. 15, 1979 [DE] Fed. Rep. of Germany ..... 2950606

[51] Int. Cl.[3] ..... B41F 7/08

[52] U.S. Cl. ..... 364/550; 101/350; 101/365

[58] Field of Search ..... 101/350, 365; 364/550, 364/519, 400; 356/382, 386, 431, 435; 250/578, 571

[56] References Cited

U.S. PATENT DOCUMENTS

| | | | |
|---|---|---|---|
| 3,702,587 | 11/1972 | Lee | 101/365 X |
| 3,835,777 | 9/1974 | Krygeris | 101/350 |
| 3,922,557 | 11/1975 | Carnes, Jr. | 356/435 X |
| 3,930,447 | 1/1976 | Murray | 101/365 |
| 4,008,664 | 2/1977 | Crum et al. | 101/350 X |
| 4,146,798 | 3/1979 | Shiba et al. | 356/435 X |
| 4,207,003 | 6/1980 | Niemiro | 356/435 X |

*Primary Examiner*—Edward J. Wise

*Attorney, Agent, or Firm*—Frishauf, Holtz, Goodman & Woodward

[57] ABSTRACT

To match the width of zone adjustment of doctor blade elements or zones of a continuous doctor blade of a printing machine inking system to pick up units of photoelectric transducers scanning patterns, in columnar zones, so that the degree of inking of the ductor roller can be matched to the degree of printing density of the pattern in the respective zones by control of the doctor blade elements or zones, the transducer arrangement includes a plurality of transducer elements of selectively different transducing widths, associated with the zones of information coverage of selectively different widths to match the width of the transducing means to the zones and for transmission of thus matched transduced signals to the printing apparatus and derive an output of utilization signals with respect to the zones of selectively different widths. Transducing elements of respectively different widths may be used (FIG. 3); or much narrower transducing elements, the outputs of which are then combined in a summing circuit and in which the number of the transducing elements, transverse to the transport direction of the pattern, is equal to the common divisor of the zone width (e.g. for zone widths of 30, 35, 40 mm, a transducer width of 5 mm); or transducers of fixed widths can be located on parallel arms of a scissor grid, the relative inclination of which with respect to the transducing direction can be changed, to provide for infinitely variable overlap, and coverage of the width of the pattern, in zones of infinitely variable dimension.

12 Claims, 6 Drawing Figures

ELECTRO-OPTICAL MEASURING APPARATUS TO COVER ZONES OF DIFFERENT WIDTHS AND OBTAIN COMPUTED UTILIZATION SIGNALS FOR PRINTING APPARATUS

The present invention relates to an apparatus for selective electro-optical analysis of zones of information coverage of selectively different widths, in which the information coverage is placed on a surface of an areal carrier, to derive utilization signals corresponding to the zones, particularly for control of ink zone adjustment means in a printing machine.

BACKGROUND AND PRIOR ART

Printing machines using a doctor blade associated with a ductor roller permit adjustment of the ink picked by the ductor roller in zones along the length of the ductor roller. The doctor blade is flexible, and by suitably controlling adjustment screws bearing against, or connected to the doctor blade, the nip or gap between the doctor blade and the ductor roller can be adjusted so that the thickness of the ink film on the ductor roller being picked up is controllable. This control is desirable since zones carrying a greater quantity or density of printing material require a greater quantity of ink than zones which are essentially clear or free of printing. Offset printing machines, thus, can provide improved quality output if the ink distribution along the circumference of the inking roller is non-uniform.

Apparatus has been proposed to determine the brightness or darkness of models, patterns or samples, or of printing plates carrying more or less information content thereon, transversely to the transport direction thereof by deriving, photoelectrically, output signals representative of the density distribution of printed material over the pattern or printing plate. The output signals can then be used directly to indicate manual adjustment of doctor blade adjustment screws, can be stored, displayed, or connected in a real-time apparatus to servo motors controlling the adjustment of doctor blade control screws.

It has been proposed to adjust the position of a doctor blade in the ink fountain system of a rotary offset printing machine by evaluating the areal coverage of a sample or pattern film, and deriving adjustment signals representative thereof to permit control and adjustment of the zone screws controlling the relative position of the doctor blade and the ductor roller (see, for example, German Patent Disclosure Document DE-OS No. 17 61 333). For example, and as described in this reference, positive film, negative film, or display patterns can be either illuminated by shining light through film, or reflecting light from the pattern or model, and deriving representative output signals; likewise, the printing plates themselves or paper patterns can be used to obtain an individual measurement to adjust the respective zone adjustment screws of the doctor blade associated with the ink ductor roller.

The measuring zone covered by the evaluation apparatus should have the same width as the control zone of the adjustment of the doctor blade in the printing machine, in which the utilization signals are to be used to control the adjustment screws of the doctor blade. It has already been proposed (see German Patent Disclosure Document DE-OS No. 26 18 387) to provide a film scanning apparatus in which a transducing apparatus is provided which has a width matching the zones which are identical to the width of the zone controlled by the adjustment screws of the printing machine, in which the pattern being analyzed is to be printed. This arrangement requires a scanning apparatus which is specific to a certain zone width, matched to the adjustment width of the printing machine, and thus cannot be used with various types of printing machines having different widths of adjustment zones, nor with models having different widths of the zones of matter to be printed.

THE INVENTION

It is an object to provide an electro-optical measuring apparatus in which the areal coverage of offset printing plates, or models or patterns from which offset printing plates can be made, are analyzed, and in which signals are derived to control ink zone adjustment screws which can be associated with ink zones of selectively different widths, so that the analysis apparatus is no longer specific only to a particular zonal width of the pattern and/or to a particular printing machine.

Briefly, in accordance with the invention, the transducing arrangement includes a plurality of transducing elements or devices which have selectively different transducing widths—with respect to the transduced direction of the carrier—and associated with the zones of information coverage of selective different widths to match the width of the transducing means to the widths of the zones. The so obtained signals, matched to the widths of the zones and/or to the zonal adjustment capability of the machine, are then connected to a computer apparatus to derive, in accordance with known signal processing, utilization output signals with respect to the regions subject to controlled inking, which may be of selectively different widths. These utilization output signals can then be displayed, stored, or directly applied to a printing machine.

Selectively different transducing width of the transducing means or apparatus can be obtained in various ways. In accordance with one arrangement, two rows of transducing elements of respectively different lengths—transversely of the direction of transport of the pattern carrier—are provided and selectively connectable to the computer so that the signals can be processed with respect to zones of different widths. By forming difference signals, as explained in the copending application Ser. No. 06/212,119, filed Dec. 2, 1980 MAMBERER and HIRT, the utilization signals will have values which are independent of the quantity of light or total light flux across the respective zones.

This arrangement has the advantage that, by using at least two, or possibly more rows of transducing elements of respectively different widths which, each, correspond to the zonal or regional widths of various types of printing machines, inexpensive construction is possible. Upon scanning of various types of patterns of respectively different zone widths of the printed matter, for example of columns of newsprint having different widths, change-over can readily be accomplished by mere operation of a change-over transfer switch. Optical-electrical transducers, such as photoelectric diodes, and the like, are inexpensive, and the entire arrangement can be easily constructed and fitted within available apparatus.

In accordance with a feature of the invention, the plurality of transducing means include a single strip of transducing elements, each of which are small in the transverse direction with respect to a zone. A suitable dimension, for example, is about 5 mm. The number of transducing elements should be equal to the common denominator of the various zonal widths. Thus, and as an example, if the zones have widths of 30 mm, 35 mm, and 40 mm, the common denominator is 5, so that transducing elements of 5 mm width are preferably used. The outputs from the respective number of transducing elements, are then combined or summed in accordance with the respective widths of the zones—for example for a zone of 30 mm, the outputs of each six adjacent transducers are added; for zones of 40 mm, the outputs of each eight adjacent transducers are added. The switch-over is simple. This embodiment has the advantage of permitting small and space-efficient construction. Summing the individually received output signals is simple and can be done inexpensively by suitable programming of the computer, or by providing inexpensive analog or digital summing or adding elements which can be readily wired and controlled by suitable programs to determine the number of outputs to be summed to form the output signal for a single zone. This system has the advantage of versatility and small space requirement at some increased cost, however, with respect to that of the previously discussed embodiment.

In accordance with a feature of the invention, the plurality of transducing means are areal transducers located along surfaces of a scissor grid which can be either partially compressed or expanded to form, in a projection transverse to the scissor plane, more or less overlapping or shaded zones of one transducer element in front of the other. The degree of shading or overlap will determine the width of the zone.

The third embodiment has the advantage of permitting continuous matching of any desired width of the ink zone to the output and is particularly suitable in installations which have various types of printing machines, or machines of various manufacturers in which the respective adjustment screws of the doctor blade cannot be readily matched to predetermined zones of the patterns or models, or with each other, and in which a single apparatus is to be used to measure and obtain output signals representative of the measurement for desired ink zone or region adjustment of doctor blade adjustment screws. This apparatus, while slightly more complex, has the advantage of infinite-width adjustment of the respective zones.

Drawings:

FIGS. 5*a* and 5*b* are a highly schematic representation of the transducer arrangement according to a third embodiment of the invention, in which FIG. 5*a* illustrates the arrangement in a position in which wide zones are being measured, and FIG. 5*b* in which the zones are narrow.

Figure 1:
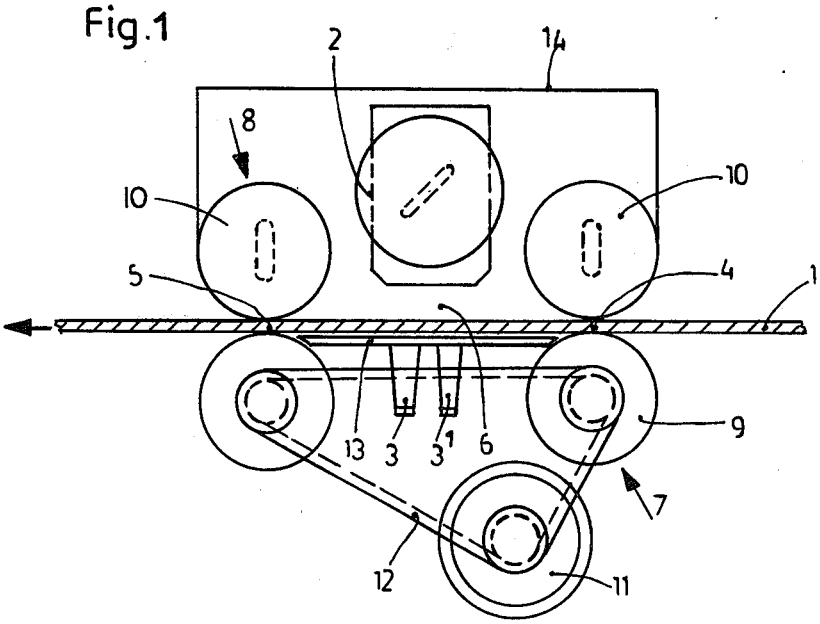
FIG. 1 is a highly schematic transverse part-sectional, part-phantom view of a film transport arrangement suitable to transport an information carrier through a measuring apparatus, and particularly suitable for use with a plurality of transducing apparatus of respectively different transducing widths.
Figure 4:
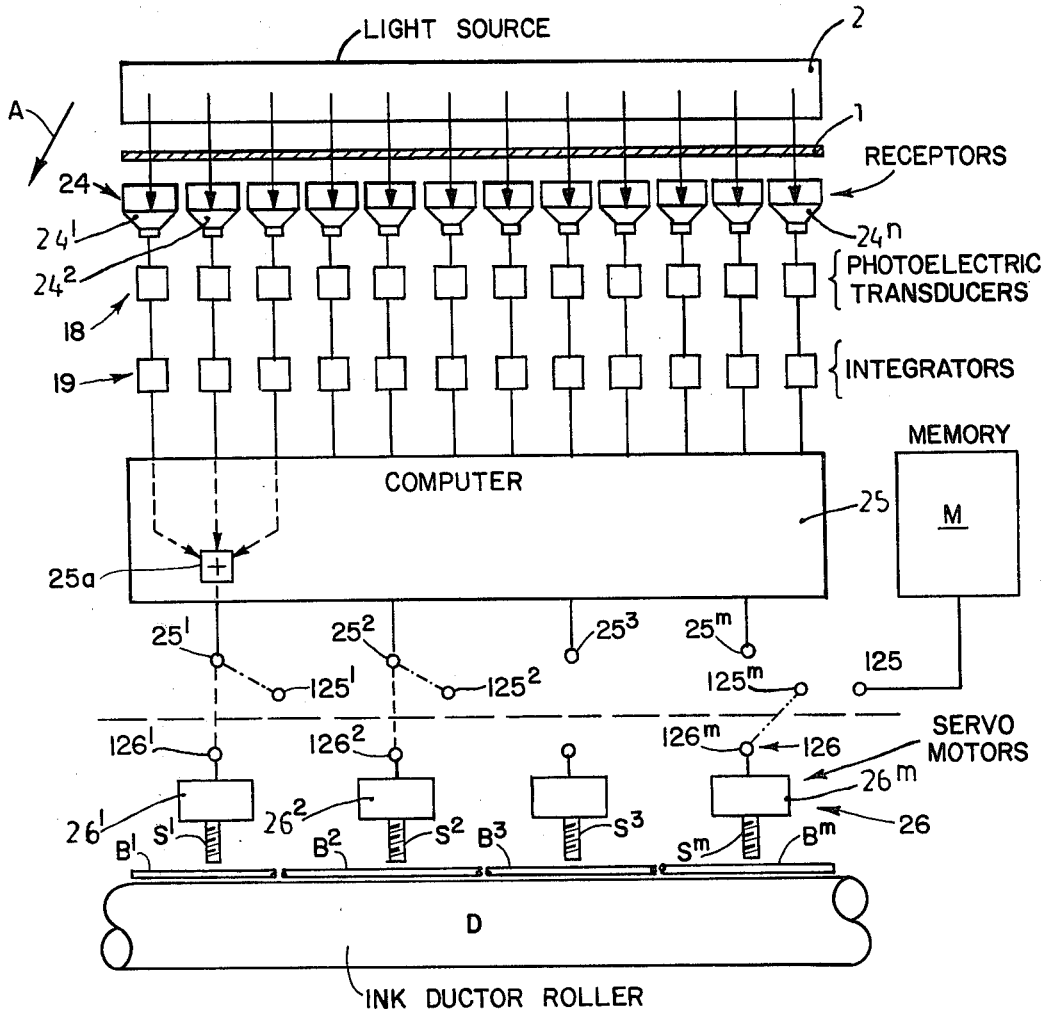
FIG. 4 is a highly schematic block diagram and layout representation of another embodiment of the invention.

General considerations and carrier transport, with reference to FIG. 1: A carrier 1, to make an offset printing plate and having an areal coverage in respective zones in which the relationship between bright zones and dark zones varies is carried in the direction of the arrow from right to left. The ink distribution is to be matched to the bright and dark zones of the film. Shown only in FIG. 4, schematically, is an ink ductor roller D, rotatable within an ink trough (not shown) of a printing machine. A plurality of doctor blades $B^1$, $B^2$, $B^3$ . . . $B^m$ can be applied against the ductor roller, or a single continuous doctor blade can be used which, since it is flexible, can have different adjustment positions at respective regions. The doctor blade elements $B^1$ . . . $B^m$ or the single flexible blade is adjusted with respect to the ductor roller D by adjustment screws $S^1$, $S^2$ . . . $S^m$, the position of which is controlled by a respective servo motor $\mathbf{26}^1$, $\mathbf{26}^2$ . . . $\mathbf{26}^m$. Reference is made to the aforementioned applications Ser. No. 185,414, REES, and Ser. No. 185,390, REES, both filed Sept. 9, 1980, which show and describe electrically controlled adjustment arrangements to adjust a doctor blade or doctor blade elements.

The film 1 (FIG. 1) is carried beneath a light source 2 and a receiving transducer 3 through a measuring chamber having an inlet slit 4 and an outlet slit 5. The measuring chamber includes a housing 14, and the inlet and outlet slits are defined by two roller pairs 7, 8, with a narrow gap therebetween to permit passage of the carrier 1 between the roller pairs. The roller pairs 7, 8 each include a transport roller 9 and a counter roller 10, between which the film 1 is carried. The relative axial position of the transport roller 9 and the counter roller 10 is adjustable, as schematically indicated by the longitudinal holding slot in the side wall 14 centrally of the counter roller 10 to form the respective inlet and outlet slits. The roller pairs 7, 8 thus not only define the slit but, additionally, provide for pull-in of the sample 1 and transport thereof through the chamber, while shielding the interior 6 of the chamber against extraneous or stray light. The rollers 9 are driven by a motor 11 which, preferably, is speed controlled to insure constant transport speed of the sample or pattern carrier 1 through the apparatus. A common motor 11 is preferably used, with a common drive belt 12 looped about the output shaft or pulley of motor 11, and the drive shaft or pulleys of the rollers 9 of the roller pairs 7, 8. Use of a single motor, with a belt drive as shown, provides for equal speed of both roller pairs 7, 8 so that the transport speed of the carrier 1 therebetween by both roller pairs will be identical so that the carrier 1 will be carried through the apparatus in tightly stretch condition. The idle rollers 10 of the pairs 7, 8 automatically match the transport speed. It has been found that a transport speed of between 1 to 3 meters per minute is suitable; the medium, about 2 m/min is preferred.

Precise guidance of the carrier 1 is obtained by providing a guide sheet 13, preferably in form of a sheet metal element, positioned between the rollers 9 of the roller pairs 7, 8. The guide sheet 13—see also FIG. 2—extends preferably up to the circumference of the respective rollers 9, and is formed with a surface to receive the carrier 1 from the inlet slit 4 to carry the carrier in flat, unbuckled and straight condition to the outlet slit 5. The combination of an outer housing 14, the shield 6, and slits formed by rollers insures guidance of the pattern 1, particularly at the end portions thereof from the inlet slit 4 to the outlet slit 5, while providing efficient shielding of the interior 6 of the thus formed chamber against ambient light, light penetrating laterally, and further providing for protection of the carrier 1 against dirt, dust or penetration of other contaminants. The cover 14, preferably, is removable.

Figure 2:
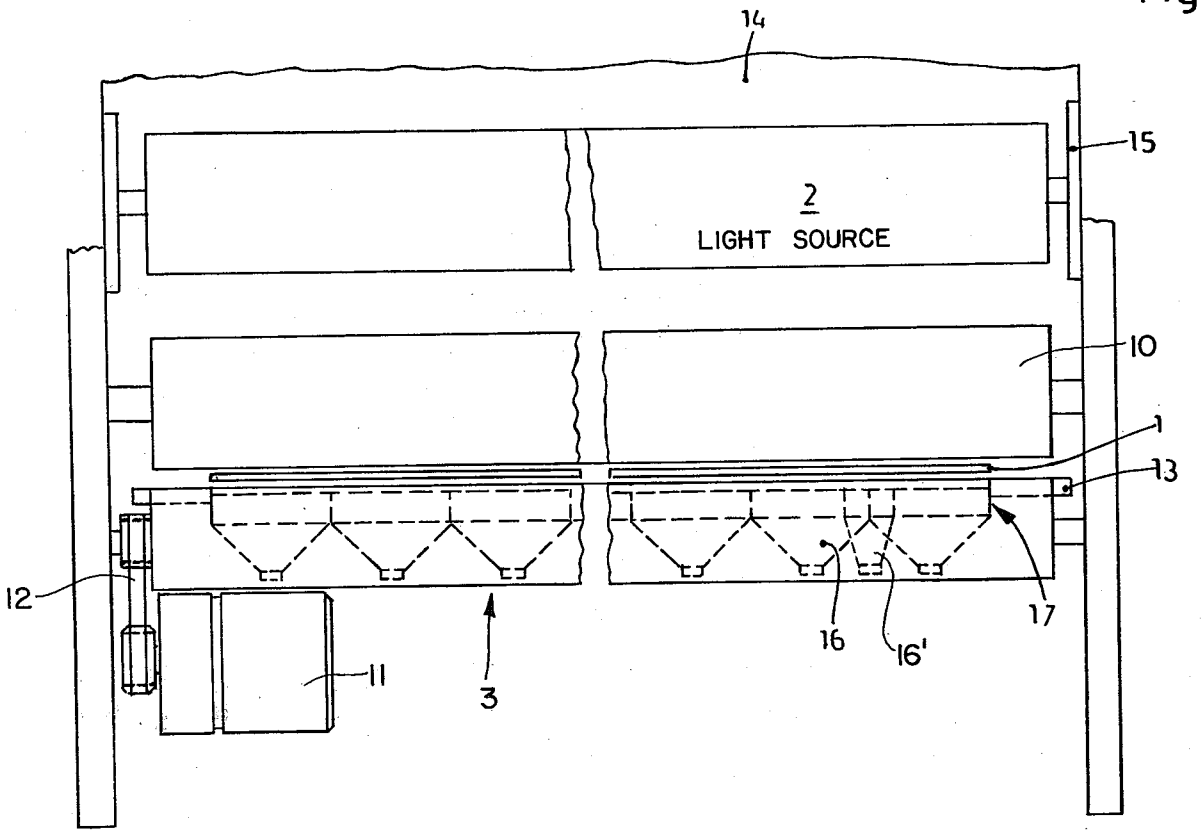
FIG. 2 is front view of the transport apparatus of FIG. 1.

FIG. 2 illustrates the arrangement of FIG. 1 with the cover 14 removed or pivoted out of covering position. The light source 2, preferably, is a commercial tubular lamp secured by end sockets 15 in the cover 14.

The receiving transducer 3, as clearly seen in FIG. 2, is subdivided across the width of the carrier 1 in a plurality of zones. It includes a plurality of receiving elements 16. The length of any receiving element 16 corresponds exactly to the width of one of the zones of a printing machine with which the apparatus is to be used. The elements 16 are located transverse to the transport direction of the carrier 1 which, with respect to FIG. 2, is in a plane perpendicular to the plane of the drawing. The width of the respective elements 16, that is, in a direction transverse to the plane of the drawing of FIG. 2, and thus the overall width of the receiving unit 3, is small in relation to the length of the element 16 and thus of the element 3, which is the dimension visible in FIG. 2. The light sensitive receiving area thus will be small so that essentially uniform illumination can be applied to all the surface areas which are illuminated. Photoelectric receivers 16, preferably, are commercial optical elements including filamentary light guides. The elements 16 are positioned in narrow gaps or slots 17 (FIG. 2) formed in the guide sheet 13 (FIG. 1).

Figure 3:
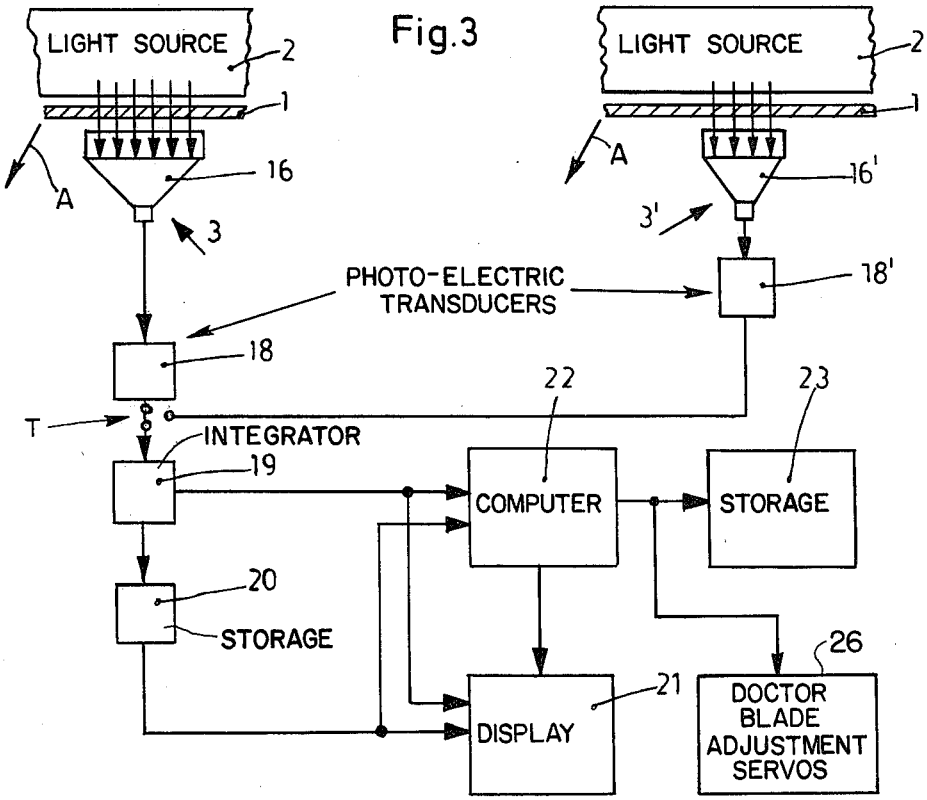
FIG. 3 is a highly schematic block circuit diagram of the apparatus of FIG. 1.

Light derived from light source 2 and illuminating the carrier 1 will provide light flux to the respective zone covered by the respective photoelectric receives 16, see FIGS. 2 and 3. The light flux—as schematically shown in FIG. 3 by the arrows through the carrier 1—is conducted by suitable optics, preferably light guide or light filamentary optics to photoelectrical transducers 18. The photoelectrical transducers, for example photo diodes, provide an electrical signal which is representative of the light intensity impinging on the receiver 3. The electrical signal is integrated in an integrator 19, connected to the transducer 18 by a transfer switch T, in order to integrate the signal throughout the length of a zone of the film 1, as it is transported in the direction of the arrow of FIG. 1 through the chamber 6. The output signal of the integrator 19 then will correspond to the areal coverage of printing indicia on the associated zone of the film 1 which will have the same width as the width of an ink zone on the printing machine. The output signal can be stored in a storage or memory unit 20 and can then be visually displayed, with respect to the appropriate zone, in a display unit 21 which, for example, is an LED display field. Additionally, the output signal can be applied to a computer 22, preferably a microprocessor, in order to compute a utilization signal which can be stored in a storage unit 23, for subsequent control of the servo motor $26^1$, $26^2 \ldots 26^m$ (FIG. 4) controlling the respective zone adjustment screws $S^1$, $S^2 \ldots S^m$ in the printing machine, or can be applied directly. Suitable storage elements are magnetic tape, punched tape similar to numerical machine tool control tape, floppy disks, and the like.

The width of the sensing elements 16, transverse to the transport direction of the film 1—see arrow in FIG. 1—corresponds to the widths of the inking zones of a predetermind printing machine. If it is necessary to sense patterns which are to be reproduced in printing machines having respectively different widths of the ink zones, then it is necessary to also consider the scanning of the zones in the scanning apparatus.

In accordance with the invention, the apparatus can scan zones of selectively different widths.

Embodiment of FIG. 3: A second receiver 3' is provided which has receivers 16', having a width which differs from the width of the receiving transducers 16. Only one such receiving transducer 16' is shown in chain-dotted representation in FIG. 2, positioned, for example, as shown in FIG. 1, in advance—in the transport direction—of the transducer 3. The receivers 16' are selectively connected to the integrator 19 by the transfer switch T when it is desired to scan zones corresponding to the width of receivers 16' which, then, is connected from the position shown to transducer 18 to the other position, that is, to the transducer 18'. The integrator 19 can operate in time multiplex mode, for example, to integrate the respective outputs from the respective photoelectric transducers 18 covering the respective widths of the zones, as shown in FIG. 3, in which the width of the zone at the left side is greater than the width of the zone at the right side. The direction of transport of the carrier 1, in each instance, of course is in a plane transverse to the plane of the drawing of FIG. 3, as schematically indicated by the arrow A. It is understood, of course, that a group formed by a plurality of receivers 16' are provided, located next to each other, of which only one is shown for clarity.

Let it be assumed that the transfer switch T is set to receive the signals from the photoelectric transducers 18'. The light received by the group of elements 16' is transferred into electrical signals in the photoelectric transducers 18', representative of the brightness or darkness or light transmissivity of the material in the respective zones covered by the receiver 16'. The signals are then applied to the circuit 19–21 rather than the signals from the transducers 18, if the transfer switch T is in the full-line position. As best seen in FIG. 3, the utilization signals for the printing machine thus can be derived either from the element 3 or the element 3'. Of course, the invention is not limited to the use of two rows of receivers 3, 3' with respective widths (FIG. 3) of receivers 16, 16' in the respective groups; more than two such rows may be provided.

Embodiment of FIG. 4: Light from light source 2 passes through the carrier film 1 moving, as in the embodiment of FIG. 3, in the direction of the arrow A, that is, transverse to the plane of the sheet of FIG. 4. A plurality of receiving elements 24, shown as individual elements $24^1$, $24^2 \ldots 24^m$, are provided each connected to a respective photoelectric transducer 18 and an integrator 19. The signals from the integrator are combined and processed in a computer 25.

For simplicity, twelve elements $24^1$, $24^2$, $24^n$ are shown. Depending on the width of the respective presentation zones, a predetermined number of elements have their respective output signals summed as indicated, schematically, with respect to the first three elements $24^1$, $24^2$, $24^3$, by the summing circuit **25*a* connected by broken lines in the computer 25**. Three elements are shown for simplicity. The added or summed signal then is connected to a respective output terminal $25^1$, $25^2 \ldots 25^m$ for connection to to input terminals $126^1$, $126^2 \ldots 126^m$ to control respective servo motors $26^1$, $26^2 \ldots 26^m$ which, in turn, cause respective projection or retraction of control screws $S^1$, $S^2 \ldots S^m$ connected to and controlling the gap between doctor blade elements $B^1$, $B^2 \ldots B^m$ from ink ductor roller D.

The output signals of three receptors $24^1$, $24^2 \ldots 24^n$ are combined in order to generate control signals for a different number of ink zone adjustment servos $26^1$, $26^2$ . . . $26^m$. The width of the zones of the receptor elements should conform to the largest common denominator of the width of the output ink zones, that is, the width of the doctor blade zones $B^1$, $B^2$ . . . $B^m$. For example, if the width of the respective zones of the doctor blade $B^1$ . . . $B^m$ are, in different machines, for example 40 mm, 35 mm and 30 mm, then the largest common divisor is 5 mm, so that the width of the respective receiving elements 24, each, must be 5 mm, or a whole fraction thereof. For a zonal width of 40 mm, eight reception units 24 are connected to have their outputs from the integrators connected together in one summing element, similar to summing element 25*a;* for a width of 35 mm, seven receptors 24 are connected; for a width of 30, six receptors 24 are connected together, and the combined measuring signals are then connected in the computer 25 for further processing. The adding or summing circuits 25*a,* thus, should be selectively connectable to the respective outputs of the receptors 24. A memory M, similar for example to the storage element 23 of FIG. 3, can be connected to the output of the computer 25, for example to respective terminals $125^1$, $125^2$ . . . $125^m$, collectively shown at terminal 125 of the memory M, for selective application of the output of the computer 25 to the memory, and reading of the output from the memory M by connection of the respective terminal 125 to the respective input terminal 126 of the servos 26, at a later time. Of course, display units similar to display 21 can likewise be connected to the output of the computer 25. The computer, as before, converts the signals received by the integrators into signals suitable for use by the respective servo motors 26 and/or a display.

Figure 5A:
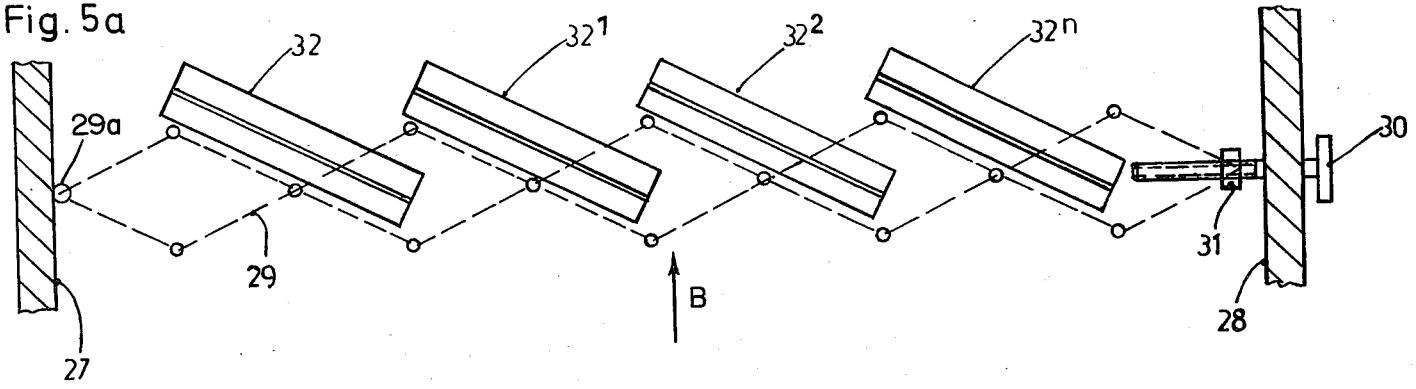
Figure 5B:
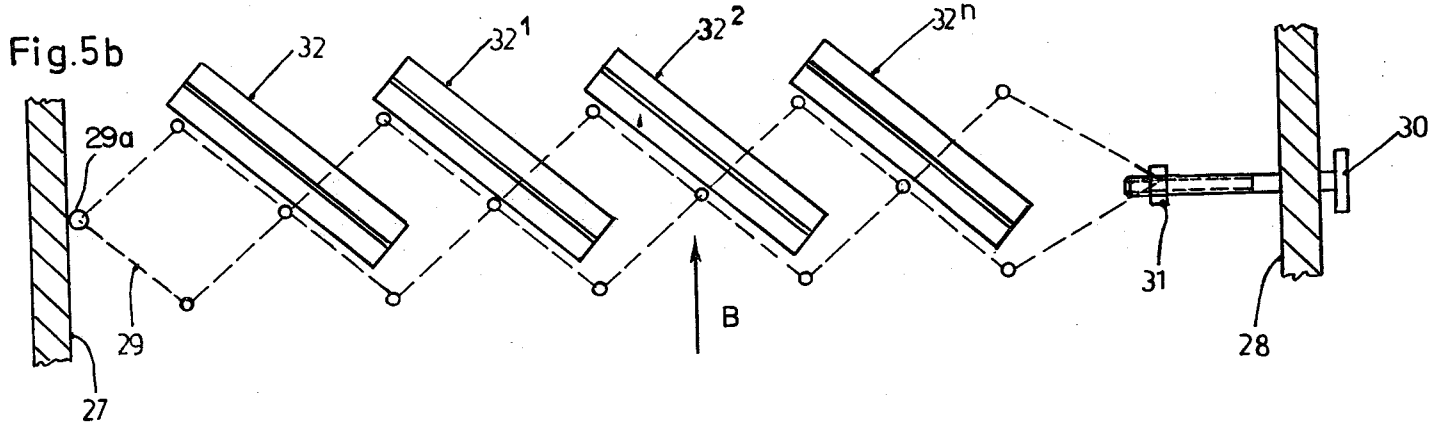

Embodiment of FIG. 5: Two side walls or frame elements 27, 28 support a scissor grid 29, or an element which has an equivalent function. The grid is secured to sidewall 27. The connection of the grid to side wall 28 is such, however, that the attachment position thereof with respect to the grid 28 is adjustable, so that the extension length of the grid can be varied. For example, the length of the grid 29 can be changed by placing a threaded spindle 30, rotatably, within the side wall, and placing a guide nut 31 thereon which, upon rotation of the spindle 30 and retention thereof in axial fixed position on the side wall 28, will cause the grid 29 to expand or contract—compare FIGS. 5*a,* 5*b,* which show the same arrangement, with different grid positions.

Parallel-positioned legs of the scissor grid 29 retain receptor elements 32, similar for example to the element 16 (FIGS. 1, 2) and which have a maximum size covering, upon complete extension of the grid (almost as shown in FIG. 5*a*), the largest zones to be measured. The measuring direction would be in a line perpendicular to a line connecting the attachment point 29*a* on wall element 27 and the nut 31. The grid 29, thus, is secured transversely to the transport direction of the pattern to be analyzed. By selection of the inclination position of the respective elements 32, $32^1$, $32^2$ . . . $32^n$, the respective overlap or shading of the elements in relation to the measuring direction, indicated schematically by the arrow B, will thus change so that the measuring zone or width of the ink zone of the pattern to be sensed can be matched to the width of the adjustment zone of a printing machine. The projection of the respective elements 32, $32^1$ . . . $32^n$ in the direction of the arrow B can be changed continuously and infinitely variable by adjusting screw 30 and thereby moving the nut 31. Within a certain operating range, thus, the arrangement can match any adjustment width of the printing machine by suitable inclination of the grid 29, that is, by operating the spindle 30 between limiting positions, and as schematically shown in FIGS. 5*a,* 5*b,* which are drawn in alignment, so that the comparison of the position of the elements 32, $32^1$ . . . $32^n$ can be readily seen.

The invention has been described in connection with light being passed through a transparent film. It is, of course, equally applicable to systems in which reflected light is sensed. The drawings are highly schematic and, for example, in the illustrations of FIGS. 5*a,* 5*b,* the thickness of the elements 32, $32^1$ . . . $32^n$ has been greatly exaggerated for clarity. In actual use, the thickness of the respective elements can be made so small that any shading due to the width of the elements themselves is neglectable.

Various changes and modifications may be made, and features described in connection with any one of the embodiments may be used with any of the others, within the scope of the inventive concept. A method of adjusting and calibrating the system is described in the referenced application Ser. No. 06/212,119, filed Dec. 20, 1980, MAMBERER and HIRT. The operation of the computer is also described therein in greater detail; its actual construction and programming can be in accordance with well known principles to convert received sensing signals to signals proper to store or display outputs suitable in a printing system. Thus, the signals need only be converted, for example by comparison with standard density signals to output signals representative of movement of the sections or regions or zones of the doctor blades $B^1$, $B^2$ . . . $B^m$ towards or away from the printing roller, that is, by deriving an error signal with respect to known standards which operates the associated servo $26^1$, $26^2$ . . . $26^m$ in the appropriate direction. Representative signals can be used for display or storage. Preferably, an analog/digital converter is included in the system connected between the photoelectric transducers 18 and the integrators 19 or between the integrators 19 and the computer to permit processing of digital signals with the attendant simplicity, economic efficiency, and reliability of digital data processing.

I claim:

1. In and for combination with a printing apparatus having means for controlling application of ink to selected surface areas of an ink receiving surface, apparatus for selective electro-optical measurement of zones of information coverage of selectively different widths on the surface of an elongated areal carrier, and deriving corresponding representative utilization signals, representative of the coverage of respective zones of the carrier by intelligence information which is optically contrasting with respect to said carrier, to permit determination of the degree of inking of regions of the surface area of the ink receiving surface, said apparatus comprising an electro-optical transducing arrangement (2, 3, 16) providing an electrical signal representative of the relative distribution of information coverage in the respective zones of the surface areal carrier, wherein the electro-optical transducing arrangement includes a plurality of light pick-ups divided into at least two groups, each group of pick-ups located in a row extending transversely to the carrier, and the rows being staggered longitudinally of the carrier, the pick-ups of the respective groups being positioned in the respective rows having individual different lengths to cover, respectively, zones of different widths on said carrier; and transfer switch means (T) selectively connecting the output from a respective group of pick-up to said ink application control means to provide signals to said ink application control means having a characteristic relative to the width of the respective zone of the carrier scanned by the pick-ups in the selected group, as selected and switched by said transfer switch (T).

2. Apparatus according to claim 1 wherein the transducer means comprises photoelectric cells.

3. Apparatus according to claim 2 further including optical elements (16, 16', 24, 32) located in light receiving relation with respect to the zones of the carrier, and optical light guide means transmitting light therefrom to the photoelectric cells.

4. In and for combination with a printing apparatus having means for controlling application of ink to selected surface areas of an ink receiving surface, apparatus for selective electro-optical measurement of zones of information coverage of selectively different widths on the surface of an elongated areal carrier, and deriving corresponding representative utilization signals, representative of the coverage of respective zones of the carrier by intelligence information which is optically contrasting with respect to said carrier, to permit determination of the degree of inking of regions of the surface area of the ink receiving surface, said apparatus comprising an electro-optical transducing arrangement (2, 3, 16) providing an electrical signal representative of the relative distribution of information coverage in the respective zones of the surface areal carrier, wherein the electro-optical transducing arrangement includes a plurality of transducer elements (24; $24^1$, $24^2$ . . . $24^n$) scanning laterally adjacent zones of said carrier, each of said transducer elements having a width which is equal to a common divisor of the respective different widths of the zones;

and a summing circuit selectively connectible to that number of transducing elements which, in the aggragate, cover the width of a zone of the carrier to provide summed signals from said selected number of transducer elements to said ink application controlled means to provide signals to said ink application control means having a characteristic relative to the width of the respective zone of the carrier scanned by the respective number of transducing elements, the output of which are summed.

5. Apparatus according to claim 4, wherein respective zones have widths which change in steps of 5 mm; and the transducing elements, each, have a width of 5 mm.

6. Apparatus according to claim 5, wherein the widths of the zones include at least one of: 30 mm, 35 mm, 40 mm width.

7. Apparatus according to claim 4 wherein the transducer means comprises photoelectric cells.

8. Apparatus according to claim 4 further including optical elements (16, 16', 24, 32) located in light receiving relation with respect to the zones of the carrier, and optical light guide means transmitting light therefrom to the photoelectric cells.

9. In and for combination with a printing apparatus having means for controlling application of ink to selected surface areas of an ink receiving surface, apparatus for selective electro-optical measurement of zones of information coverage of selectively different widths on the surface of an elongated areal carrier, and deriving corresponding representative utilization signals, representative of the coverage of respective zones of the carrier by intelligence information which is optically contrasting with respect to said carrier, to permit determination of the degree of inking of regions of the surface area of the ink receiving surface, said apparatus comprising an electro-optical transducing arrangement (2, 3, 16) providing an electrical signal representative of the relative distribution of information coverage in the respective zones of the surface areal carrier, wherein the electro-optical transducing arrangement includes an adjustable parallel linkage support system (27, 28, 29, 30, 31) and transducing elements (32, $32^1$ . . . $32^n$) secured to parallel links of said parallel linkage, the parallel linkage being mounted transversely to the width of the carrier, adjustment of the angle of inclination of the adjustable parallel linkage providing for selectively adjustable coverage of zone of the carrier.

10. Apparatus according to claim 9, wherein the adjustable parallel linkage comprises a scissor grid, and elongation setting and control means (30, 31) adjustably positioning the extension of said grid and thus changing the angle of inclination of the transducing elements, and hence the projected width thereof with respect to the zones of the carrier.

11. Apparatus according to claim 9 wherein the transducer means comprises photoelectric cells.

12. Apparatus according to claim 11 further including optical elements (16, 16', 24, 32) located in light receiving relation with respect to the zones of the carrier, and optical light guide means transmitting light therefrom to the photoelectric cells.

* * * * *